United States Patent [19]

Armellino

[11] 3,988,780

[45] Nov. 2, 1976

[54] FABRICATION OF ARMORED FABRIC

[76] Inventor: Richard A. Armellino, 17 Forestdale Drive, Huntington, N.Y. 11743

[22] Filed: June 28, 1971

[21] Appl. No.: 157,555

Related U.S. Application Data

[63] Continuation-in-part of Ser. No. 710,407, March 4, 1968, abandoned.

[52] U.S. Cl. ..... 2/2.5

[51] Int. Cl.[2] ..... F41H 1/02

[58] Field of Search ..... 2/2, 2.5; 161/404; 112/438

[56] References Cited

UNITED STATES PATENTS

| | | | |
|---|---|---|---|
| 1,423,479 | 7/1922 | De Voe | 112/438 X |
| 2,466,577 | 4/1949 | Kropscott et al. | 161/404 |
| 2,697,054 | 12/1954 | Dietz et al. | 161/404 |
| 2,778,761 | 1/1957 | Frieder et al. | 161/404 X |
| 2,789,076 | 4/1957 | Frieder et al. | 161/404 X |
| 2,816,578 | 12/1957 | Frieder et al. | 2/2.5 X |
| 3,018,210 | 1/1962 | Frieder et al. | 2/2.5 |
| 3,398,406 | 8/1968 | Waterbury | 2/2.5 |
| 3,519,529 | 7/1970 | Cook | 2/2.5 X |
| 3,562,810 | 2/1971 | Davis | 2/2.5 |

FOREIGN PATENTS OR APPLICATIONS

| | | | |
|---|---|---|---|
| 1,113,396 | 12/1955 | France | 2/2.5 |

*Primary Examiner*—George H. Krizmanich
*Attorney, Agent, or Firm*—Lewis H. Eslinger; Alvin Sinderbrand

[57] ABSTRACT

Reinforced body armor and the like is fabricated by securing a plurality of layers of material, having qualities resistant to ballistic penetration, along paths spaced within a selected predetermined range, so as to restrict movement of the fabric layers in lateral and longitudinal directions and to compact the layers in an elastic mass thereby to provide improved resistance to penetration of the material by a ballistic missile and to partially stiffen the material so that shock waves and the force of impact of the missile are distributed over a relatively large area adjacent the point of impact of the missile to reduce back target distortion.

9 Claims, 3 Drawing Figures

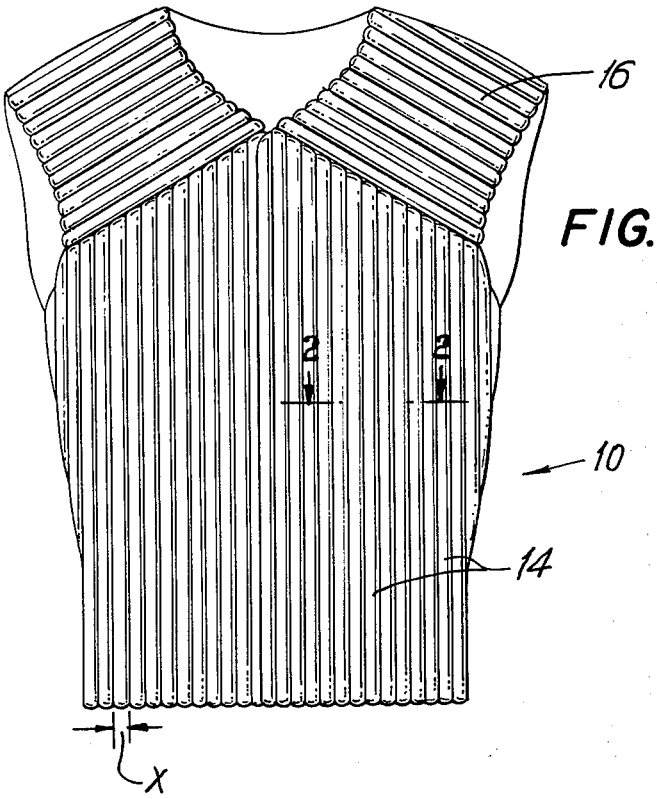
FIG. 1
FIG. 2
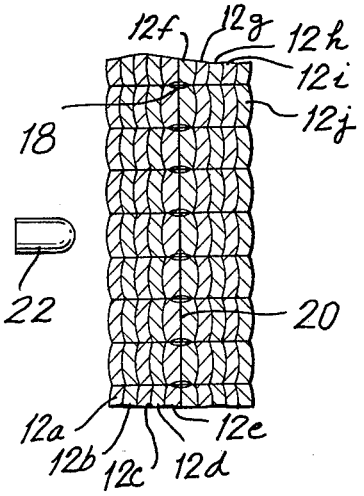
FIG. 3
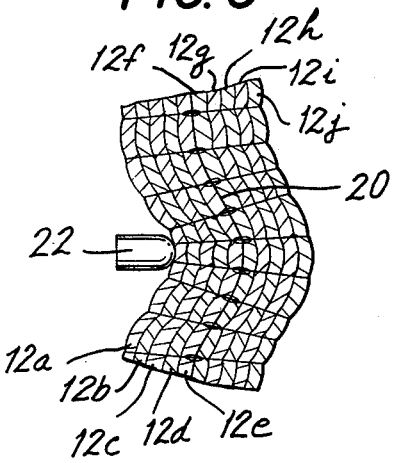
INVENTOR.
RICHARD A. ARMELLINO
BY Lewis H. Eslinger
ATTORNEY

FABRICATION OF ARMORED FABRIC

This application is a continuation-in-part of my copending application Ser. No. 710,407 filed Mar. 4, 1968 and now abandoned, the disclosure of which is incorporated herein by reference.

This invention relates to multilayer ballistic cloth resistive to penetration by flying fragments, missiles and the like and more particularly to improved reinforced ballistic cloth and body armor such as may be used in the protection of military personnel, police officers, boats, vehicles, and aircraft.

In previously proposed ballistic cloth and body armor of the above type, the armor generally is fabricated with the use of some woven material, such as for example, nylon ballistic cloth, inserted in one or more layers between liners of a garment, such as a vest, to be worn by an individual. The garment is generally worn close to the body and must not only resist penetration by a ballistic missile or the like, but must also provide sufficient resistance to excessive elongation of the material upon impact by the missile so as to limit back target distortion. The latter is a term utilized in the art to refer to the distortion of the back surface of the garment against the body of the wearer, upon missile impact, which applies extremely high forces to the wearer, in a localized area, resulting in possible injury to him even if the missile does not pierce the garment.

An undesirable problem which occurs in presently used ballistic cloth and armored garments is that although the material may prevent complete penetration of the missile it is, nevertheless, unable to adequately protect the wearer since the shock and missile impact forces are transmitted to the body as a result of the excessive back target distortion and elongation of the material. This problem occurs because the previously proposed ballistic cloths used in fabricating such garments are generally assemblies of loosely interconnected layers of fabric so that the layers do not work as a whole in resisting distortion upon missile impact, with the result that relatively deep localized back target distortions occur. Since the fabric layers are loose and do not work together, there is insufficient internal density to cushion the force of impact and the layers of material are penetrated individually by the missile so that there often is insufficient resistance to penetration of a garment by the missile.

To overcome these difficulties, a number of previously proposed garments often use metallic plates disposed between the layers of ballistic cloth or in pockets within the garment to resist penetration by bullets and shrapnel and to limit distortion. However, such vests are both cumbersome and heavy and often restrict the ability of the wearer to such a great extent that the use of the vest is more detrimental than beneficial.

Accordingly, it is an object of the present invention to provide improved resistance to ballistic penetration by armored fabric.

It is another object of the present invention to decrease the back target distortion of armored fabric upon impact with a ballistic missile.

Another object of the invention is to provide body armor formed from an improved reinforced armored fabric.

In the use of layers of ballistic cloth for personnel armor and the like, the energy of the missile striking such cloth is dissipated in several ways. The initial impact absorbs part of the energy which is imparted laterally from the point of impact. If the kinetic energy of the missile is sufficient to cause any penetration, the coefficient of friction and drag of the material against the missile further absorbs energy. If the missile is turned or deflected, the area over which the energy is absorbed is correspondingly increased. In addition, the amount of elasticity in the material and the area within which said elasticity can be utilized will absorb some of the energy of the missile. To be effective and to be of practical use, the armor must overcome all of the kinetic energy of the missile in the distance permitted between the outside of the fabric of the garment of the body of the wearer. The same is true in the use of such armor for other purposes, such as flack curtains and aircraft armor, although for the latter two, the distance within which the missile must be stopped is not as critical, nor is the amount of back target distortion as critical since the force of the impact is not applied directly to a human being, but to the inanimate article being protected.

The present invention provides improved protective material which utilizes the best qualities of the energy dissipating features of the known ballistic cloths, i.e. its elastic mass, while minimizing the least desirable feature, the fact that the mass distorts to cause possible damage to the wearer. This is achieved in the present invention by providing a plurality of layers of ballistic fabric sewn, or otherwise joined together, along a plurality of continuous paths spaced apart within a selected predetermined range so as to form a composite sheet of reinforced armored fabric which constitutes a relatively solid mass which resists penetration by missiles and yet has sufficient flexibility to maintain its elastic characteristics and decrease back target distortion by transmitting the shock waves of impact laterally away from the point of impact through the mass of the fabric in a large area surrounding that point.

The ballistic cloth utilized to form a reinforced article of the present invention typically is formed of woven nylon or the like which, in individual and unconnected sheets, is in a soft plyable condition so as to stretch or distort under impact of a missile over a relatively small area. By sewing or otherwise joining a plurality of layers of such ballistic material together, in accordance with the invention, this distortion is reduced since the relatively elastic mass thus formed distributes the force of impact of the missile over a relatively large area of the composite sheet. As a result, the force of impact will be transmitted to a larger, less localized, area of a wearer's body and the possibility of injury is decreased. The material used to form the reinforced article of the invention still stretches upon impact, but this stretch is controlled by the joining of the fabrics along spaced paths within a predetermined range, so that the layers of fabric act together as a mass rather than as individual layers whereby the desired result of improving the protection afforded a wearer of a garment, formed of this fabric, from back target distortion is achieved without appreciably increasing the weight of the garment or cloth. In addition, while the elastic mass thus acts to decrease the back target distortion, the fact that the material is restricted by the sewing along the spaced lines increases the coefficient of drag of the material, when and if the layers of material are pierced, so that the missile is stopped in a shorter distance. Moreover, the elasticity of the material causes the fabric to assume its original shape after impact.

The above, and other objects, features and advantages of this invention, will be apparent in the following detailed description of an illustrative embodiment thereof which is to be read in connection with the accompanying drawings wherein:

FIG. 1 is a front elevation view of body armor, in the form of a vest, fabricated from reinforced ballistic material in accordance with the present invention;

FIG. 2 is an enlarged sectional view taken on line 2—2 of FIG. 1 showing a plurality of layers of ballistic cloth, with stitches securing the fabrics together; and showing the same about to be struck by a bullet; and FIG. 3 is a view similar to FIG. 2, but showing cloth as it is being struck by the bullet.

Referring to the drawings in detail and initially to FIG. 1 thereof it will be seen that a garment 10, fabricated from reinforced ballistic material, as shown therein, is formed in the shape of a vest such as that which may be worn by a soldier or police officer to protect the chest and vital organs of the body.

In the illustrative embodiment of the present invention the vest 10 is formed, as seen in FIG. 2, from 10 superimposed layers 12*a* . . . 12*j* of a conventionally available ballistic cloth, such as that described in U.S. military specifications MIL-C-12369E (July 25, 1968) available through Naval Supply Depot 5801 Tabor Avenue, Philadelphia, Pennsylvania, (the description of which is incorporated herein by reference) and which generally consists of a fabric woven from continuous filament nylon yarn. However, the invention is not limited to use with this specific material and it should be noted that other fabric materials may also be utilized to the same end in accordance with the present invention, which fabrics may be formed of woven dacron, polyesters, phenolics, plastics or even woven metal wires.

Moreover, while ten layers of fabric are utilized in the illustrative embodiment, it is contemplated that the number of layers may include as few as two or any number of layers, depending upon the type of missile expected to be encountered and the amount of protection required.

The layers 12*a*–12*j* of garment 10 are each secured to each other, across their entire area, by stitching, or otherwise, which is disposed in parallel paths or lines having a distance X therebetween. This distance, in the preferred embodiment of the invention is ⅜ inches. However, the spacing may be selected from within a range of no less than ⅛ to ¾ inches depending on the number of fabric layers utilized and the amount of protection desired.

While in the illustrative embodiment of the invention, vest 10 has been shown with two sets of parallel paths, i.e. paths 14 over the chest portion of the garment and angularly related paths 16 on the shoulders, it is contemplated that a single set 12 may be used which extends upwardly from the front of the vest directly over the shoulders and down the back. Further, the pattern of stitching need not be restricted to the parallel lines in FIG. 1, but may take other configurations, so long as adjacent lines of stitches are continuous and sufficiently close, i.e. within the specified range to compact the layers over their entire area and to restrict the movement of the various threads making up the individual layers of ballistic material.

As a result of securing each of the individual layers 12 together in this manner a relatively rigid, yet elastic mass is provided which has increased capacity to absorb the impact forces of ballistic missiles as compared to a corresponding number of loosely connected cloth layers. Thus, when the outer layer 12a is struck by a missile, it will almost instantaneously compress and transmit force to the second layer 12b, which in turn will transmit force to the third layer 12c, and so on through the layers 12*c*–12*j*, converting the kinetic energy of the missile to potential energy in the compressed material, whereby the compressed cloth transmits the potential energy through the body of the material forming the garment.

The critical feature of the present invention is the separating or spacing between adjacent stitching paths 14 holding the various layers of the material together. As mentioned, it has been found that the X distance preferably must be within the range of between ⅛ and ¾ inches. If the distance separating the stitching paths is less than ⅛ inches, the layer assembly becomes too brittle and the force of a missile impacted against the fabric is not distributed to the adjacent areas to any substantial extent. On the other hand, if the distance separating the stitching paths is greater than ¾ to 1 inch, then the layer assembly is not sufficiently compacted to provide high resistance to penetration, reduction of back target distortion, or deflection of missiles impacted against the armor.

The stitches utilized to form the stitch paths 14 connecting the various layers of fabric 12*a*–12*j* are preferably continuous lock stitches 18 of the type shown in FIG. 2 which are formed in a conventional manner from two lengths of thread locked together substantially at the center 20 of the material.

It has been found that as few as four or as many as 10 to 15 such stitches to the inch are required to compact the layers of the material in the desired manner, while maintaining resilience of the material to absorb the impact shock of the bullet or ballistic missile. However, in the preferred embodiment it has been found that six to eight stitches operate in a satisfactory manner to provide the desired characteristics for properly reinforcing the layers. By the use of such stitching, if there is any penetration and tearing of the material by a ballistic missile upon impact, the tear will be restricted due to the fact that it is not permitted to move beyond the next line of stitching. Thus the integrity of the surrounding areas of the garment is maintained and held in a compressed condition by adjacent lines of stitches 14 so that it can perform the desired function of distributing impact forces over the surrounding area of the garment. Moreover, the compactness of the compressed cloth will increase the drag on the missile or bullet so that the bullet is slowed down and stopped in a shorter range.

While layers 12 of ballistic cloth have been described above as being interconnected or secured by lock stitching, the invention is not restricted to this type of stitching and other stitching or sewing methods and even means other than sewing can be used to interconnect the cloth layers. Such other stitching methods may include conventional chain or zig-zag stitching with the thread used in any of the stitching methods being formed of any conventional material but preferably nylon. The other types pf layer securing systems that can be used include stapling, riveting, welding, heat and adhesives or other such means known in the art, so long as the lines of interconnection of the layers of material are within the critical spacing distances referred to above. Further, while the invention has been described with respect to a vest formed of interconnected reinforced layers of material other garments and protective sheets may be formed with this reinforced material, such as for example, shirts, jackets, pants, ponchos, and sheets for wrapping or protecting cargo, weapons, or individuals.

In use, when the vest 10 is struck by a bullet or other missile 22, such as illustrated in FIGS. 2 and 3, the combined layers of material 12*a*–12*j* which have compact and dense characteristics as a result of being sewn together in accordance with the invention, will be highly resistant to the force of impact. However, this mass retains a controlled elastic characteristic so that, at the same time, the cloth may flex to resist and distribute the force of impact over a relatively large area of the cloth bordering the point of impact.

Typically, with previously proposed ballistic and armored fabrics, wherein the layers are loosely interconnected, the point of impact will provide a protrusion at the back of the fabric along a relatively small or localized area surrounding the point of impact, which protrusion, or back target distortion, transmits the force of impact of the bullet to the wearer of the garment. By construction the garment in accordance with the present invention the shock from the impact is dissipated through a large area of the cloth bordering the point of impact so that the force of the projectile will be transmitted against a larger portion of the body of the wearer so as to decrease the possibility of injury as a result of this impact. As the bullet loses its forward momentum it falls off the garment and the latter will return to its original shape to withstand further impacts by projectiles.

It has further been found that by stitching the material in the manner described, each of the layers of the material are tensioned and flexed to provide an angled surface of top layer 12*a* between the lines of stitches, with the surface of each layer of the material similarly angled, so that when a projectile, particularly projectiles traveling at relatively low velocities, is impacted against the material, it will be slightly deflected from the material. This feature further enhances the protection afforded by reinforced ballistic cloth in accordance with the invention.

It is thus seen that a new and improved reinforced ballistic covering is provided which utilizes a plurality of layers of ballistic material secured together along spaced paths and which may be utilized to form a garment or protective sheet to provide effective protection against missile penetration. A ballistic sheet constructed in accordance with the present invention effectively dissipates missile impact over an area sufficiently large to leave the wearer uninjured and retains its shape after being struck while it may be utilized to form an effective, efficient, and lightweight garment.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A protective material comprising:

1. a plurality of layers of ballistic material,
2. said layers of material being formed of woven continuous filament synthetic yarns,
3. securing means extending along spaced continuous paths interconnecting said layers,
4. said securing means comprising a plurality of continuous uninterrupted stitches at least through a substantial portion of each path will each stitch interconnecting said layers together,
5. said paths being spaced a distance no greater than three-fourths of an inch and no less than one-eight of an inch.

2. The material of claim 1 wherein:

6. said plurality of layers include an outer layer,
7. said outer layer being tensioned and flexed by said securing means to provide an angled surface to a missile impacting normally to said material so as to tend to deflect missile from said material.

3. The material as defined in claim 2 wherein:

6. the stitches are four to fifteen stitches to an inch.

4. The material as defined in claim 1 wherein:

6. said paths are disposed along substantially parallel lines;
7. said material being free of securing means extending in a path intersecting said parallel paths.

5. The material of claim 1 wherein:

6. said plurality of layers of ballistic materials is in the form of a vest having dimensions to cover portions of the wearer's body.

6. The material as defined in claim 1 wherein said paths of stitches are relatively parallel to each other.

7. The material as defined in claim 1 wherein the ballistic material is formed of woven nylon fibers and said stitches each comprise a nylon thread joining the layers together.

8. The material as defined in claim 1 wherein said stitch paths are spaced ⅜ of an inch apart.

9. The material as defined in claim 1 wherein the stitches are four to eight to the inch.

* * * * *